United States Patent [19]

Claesson

[11] 3,958,482

[45] May 25, 1976

[54] MACHINE FOR CUTTING MATERIAL

[75] Inventor: Knut Hjalmar Claesson, Overlida, Sweden

[73] Assignee: Nordisk Kartro Aktiebolag, Sweden

[22] Filed: Apr. 15, 1975

[21] Appl. No.: 568,305

[30] Foreign Application Priority Data

Oct. 16, 1974 Sweden ..... 7413058

[52] U.S. Cl. ..... 83/559; 83/581; 83/620; 83/693; 83/917

[51] Int. Cl.[2] ..... B27G 5/04

[58] Field of Search ..... 83/581, 559, 620, 641, 83/693, 917; 144/217, 216

[56] References Cited

UNITED STATES PATENTS

| | | | |
|---|---|---|---|
| 2,555,069 | 5/1951 | Verney | 83/559 X |
| 2,767,789 | 10/1956 | Budlong et al. | 83/559 X |
| 2,837,160 | 6/1958 | Vera et al. | 83/641 X |
| 3,521,515 | 7/1970 | Aramini | 83/641 X |

*Primary Examiner*—J. M. Meister

*Attorney, Agent, or Firm*—Hill, Gross, Simpson, Van Santen, Steadman, Chiara & Simpson

[57] ABSTRACT

A machine for cutting material, such as wood comprising knives angularly adjustable around an axis and adapted to cut the wooden material angularly in cooperation with suitable anvils, each knife being journalled on a journal column which is angularly adjustable around said axis jointly with the respective anvil.

5 Claims, 5 Drawing Figures

MACHINE FOR CUTTING MATERIAL

BACKGROUND OF THE INVENTION

1. Field of the Invention

The invention relates to a machine for cutting material, comprising knives angularly adjustable around an axis and adapted to cut material angularly in cooperation with suitable anvils.

2. Prior Art

Machines for cutting wooden material are known in various designs, such as from French Pat. No. 1,518,343, British Pat. No. 237,812, German Pat. No. 157,068, and my own Swedish Pat. No. 370,349.

Many of these prior art machines have fixed knives, and are not angularly adjustable to cut in different angles as desired, whereas those machines which have angularly adjustable knives are complicated to adjust properly.

SUMMARY OF THE INVENTION

According to the present invention, each knife is journalled for movement in the cutting direction on a journal column which is angularly adjustable around said axis jointly with the respective anvil. Since each knife is angularly adjustable jointly with its respective anvil the proper operational relationship between each knife and its respective anvil will always be automatically maintained with each and every adjustment of the knives and associated anvils.

Figure 4A:
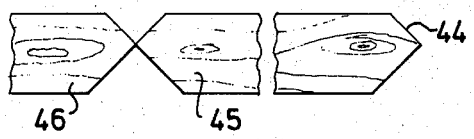
Figure 4B:
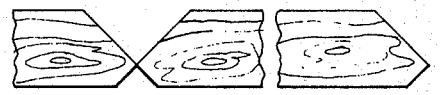

FIGS. 4*a* and 4*b* show schematically two ways to cut wooden material by means of the machine according to the invention.

AS SHOWN IN THE DRAWINGS:

The machine has a frame, generally denoted 10, comprising a base plate 11 to which two vertical tubular columns 12 and 13 of square or rectangular cross-section are secured by welding. In the upper end of each of the tubular columns there is secured by welding an end piece, exemplified in FIG. 2 by the end piece 14, which has a threaded hole to receive a mounting bolt 15. A beam 16 of U-shaped cross-section extends across the machine between the upper ends of the tubular columns 12 and 13 and is bolted to the tubular columns 12, 13. The frame further comprises a ring member 17 which is secured to the base plate 11 by welding. The ring member 17 is provided with a circumferential undercut groove 18. The ring carries four anvils or dies 19 which are essentially triangular and extend inwardly towards the vertical central axis C of the machine, FIG. 2. Each anvil 19 has in its under surface a machined arcuate groove and grips over a portion of the ring member 17 to which the respective anvil is secured by means of two screws 21, 22, FIG. 3, which engage with one nut 23 each in the undercut groove 18.

Figure 1:
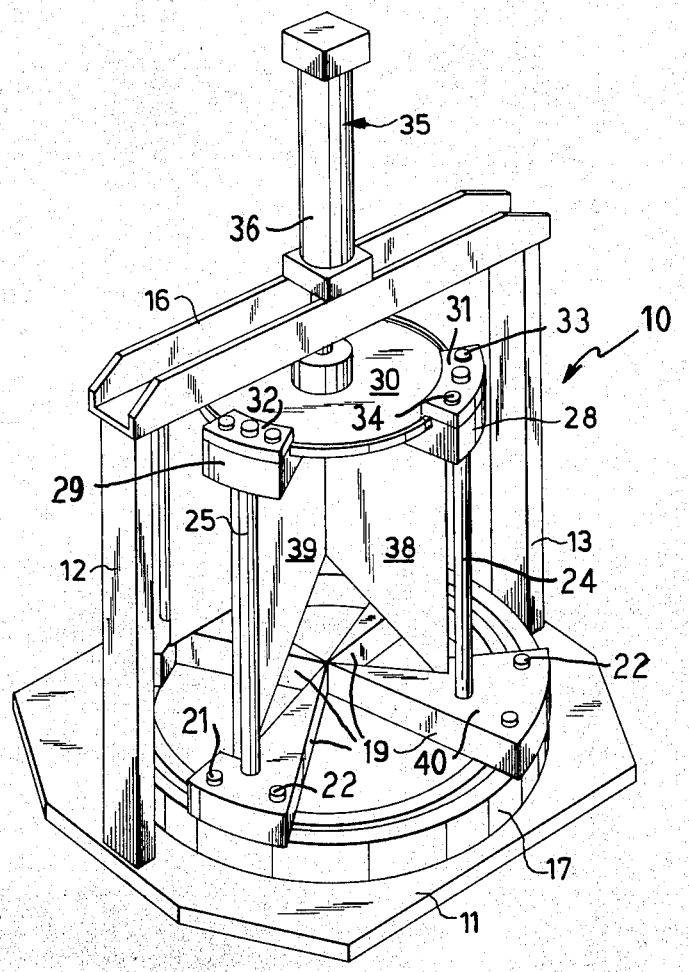
FIG. 1 is a perspective view, partly in section, of a machine according to the invention.
Figure 2:
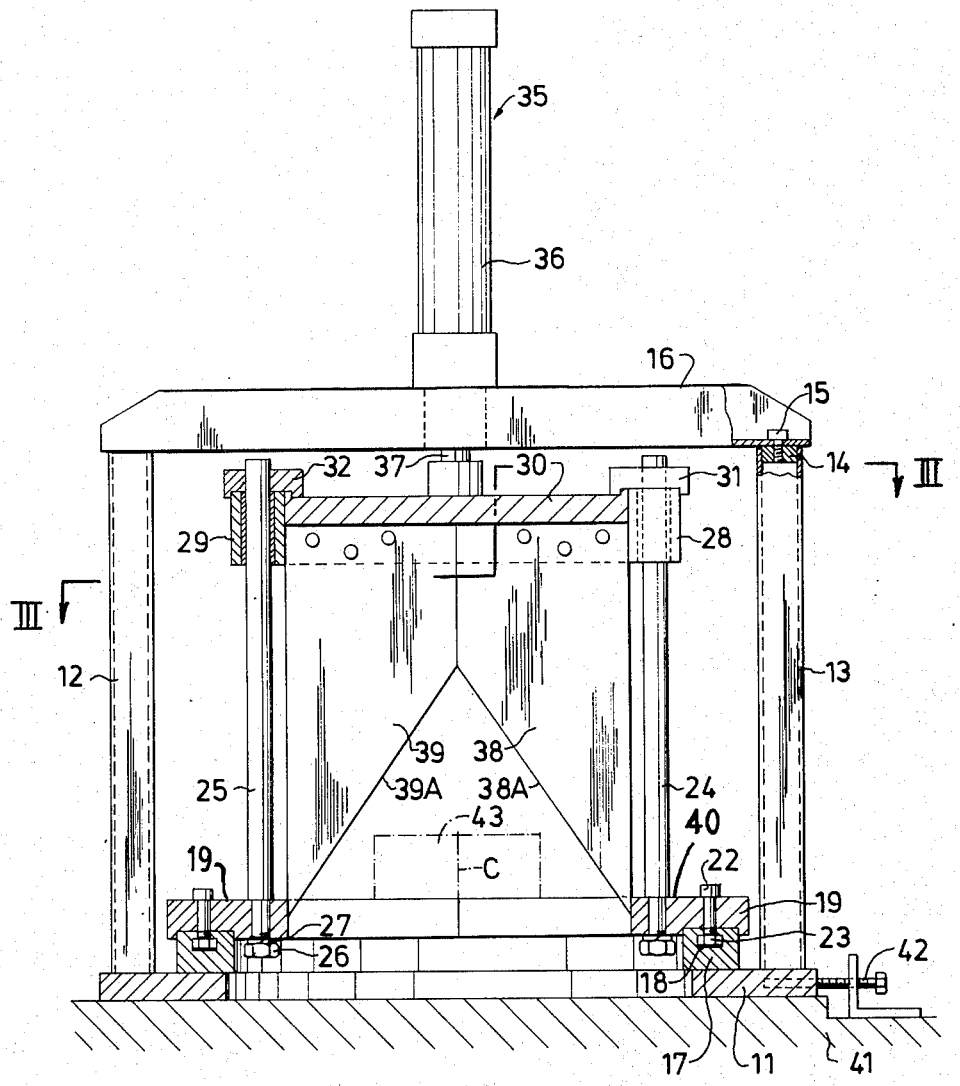
FIG. 2 is a side view, partly in section, of the machine.

From each anvil 19 there extends upwardly, slightly inside the ring member 17, a journal column 24 and 25, respectively, FIG. 2, which journal columns 24, 25 are secured to their respective anvil 19 by means of a nut 26 with a suitable lock washer 27.

Figure 3:
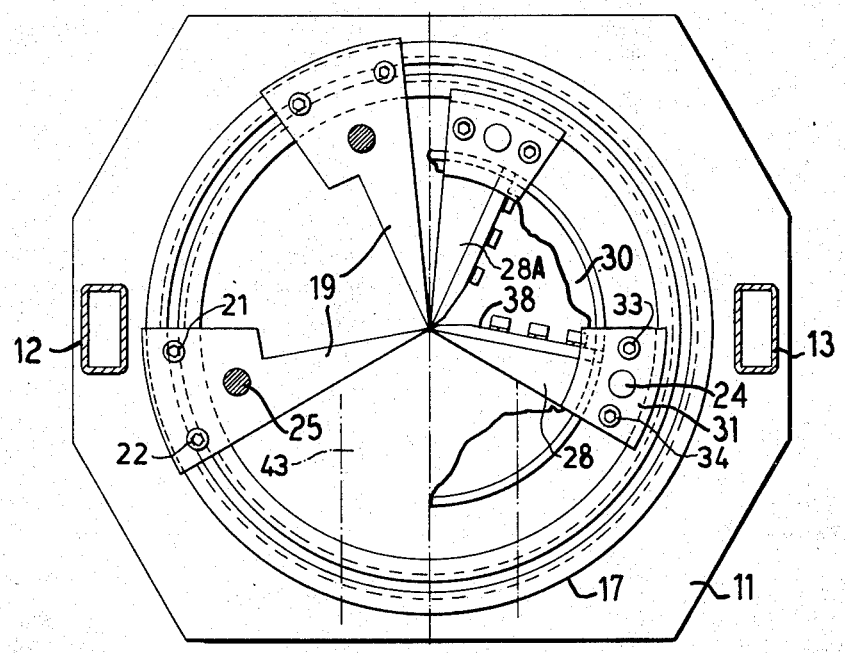
FIG. 3 is a plan view, partly in section, taken along line III—III of FIG. 2.

Each journal column 24, 25 journals a vertically movable knife holder 28 and 29, respectively, which knife holders, as seen in plan view, are essentially triangular, see FIG. 3. The knife holders 28 and 29, respectively, are clamped to a circular press plate 30 by means of a pair of clamping pieces 31 and 32, respectively, which are bolted to their respective knife holder by means of two screws 33, 34, FIG. 3, in a manner to clamp the press plate 30 between the knife holder 28, 29, respectively, and the associated clamping piece 31 and 32, respectively.

A hydraulic cylinder, generally denoted 35, has the cylinder portion thereof rigidly secured to the U-beam 16, whereas the piston rod 37 passes freely through the U-beam 16 and is rotatably but axially nonslidably connected to the press plate 30.

Each knife holder 28 and 29, respectively, carries a knife 38 and 39, respectively. The edge line 38*a* and 39*a*, respectively, is inclined vertically and extends from the central axis C radially outwardly and downwardly below the upper surface 40 of the associated anvil such as the anvil 19.

In the example shown the machine is disposed on a support 41 and is laterally adjustable with respect to the support 41 by means of a suitable adjusting device, exemplified by the screw 42.

In FIG. 2 there is shown the cross-sectional contour of a piece of wood 43, the end of which should be cut at two different angles by means of the machine according to the invention.

The described machine operates in the following way:

In order to adjust the machine into the desired cutting angles the securing bolts 21 and 22 for the anvils 19 are first loosened, and further the screws 33, 34 are loosened for each knife holder which is to be adjusted. Then, the anvils 19 are adjusted around the central axis of the machine into the desired cutting angle. Preferably, the adjustment of the anvils 19 in relation to the ring 17 takes place while properly positioning an index mark on the anvils 19 against a graduated scale on the ring 17. As the anvils 19 are adjusted into the desired angular position the journal columns 24 and 25, respectively, are simultaneously adjusted, whereby the knife holders 28, 29 join the movement so that also the knives 38 and 39, respectively, are adjusted around the central axis of the machine. When the desired angular position has been attained, the anvils and the knife holders are locked in the adjusted position by tightening the screws 21, 22 and 33, 34, respectively. If the cutting should be done in such a manner that the apexes of the cut wood pieces are disposed near the longitudinal center lines of the wood pieces such as shown in FIG. 4*a*, then the machine would be ready for operation following the above described adjustment. If it is desired to have the apexes of the wood pieces displaced further from the longitudinal center lines, then the machine has to be correspondingly laterally displaced which in the example shown is brought about by a corresponding adjustment of the screw 42.

In use of the machine, one end of the work-piece, the end 44 in FIG. 4*a*, is first cut by means of two of the positioned knives and then the workpiece is pushed through the machine, e.g. to engagement with a stop abutment which has previously been positioned as desired. Then the cylinder 35 is again pressurized, either through a manually actuated valve or through a valve actuated by the stop abutment, so that the cylinder 35 performs another operational stroke to cause a simultaneous cutting of the rear end of a first work piece, i.e. the end 45 in FIG. 4*a*, and of the front end of a second or subsequent work piece, i.e. the end 46 in FIG. 4*a*, in one and the same operational stroke.

Although various minor modifications might be suggested by those versed in the art, it should be understood that I wish to embody within the scope of the patent warranted hereon all such embodiments as reasonably and properly come within the scope of my contribution to the art.

What I claim is:

1. A cut-off machine, comprising:

a. a ring member;

b. at least two anvils, each of which is separately securable to said ring member in an angularly adjustable position about a common axis;

c. a plurality of journal columns respectively secured to said anvils and extending parallel to said axis, and respectively positionable with each said anvil in said angularly adjustable position;

d. a plurality of knife holders respectively slidably carried on said journal columns;

e. a plurality of knives respectively secured to said knife holders and coactive with that one of said anvils to which its said journal column is secured, for simultaneously cutting action; and f. a circular press plate adapted to be driven toward and away from said anvils, and connected to said knife holders to reciprocate them.

2. A cut-off machine according to claim 1 in which each of said anvils is generally triangular with a point of its triangular shape extending to said common axis.

3. A cut-off machine according to claim 1 in which there are four of said anvils, and a like number of said journal columns, knife holders, and knives.

4. A cut-off machine according to claim 1 which includes releasable means clamping said knife holders to the periphery of said circular press plate.

5. A cut-off machine according to claim 1 including a support slidably supporting said ring member for linear movement, and means acting between said support and said ring member for displacing said ring member in a direction transverse to the cutting edges of all of said knives.

* * * * *